US011261609B2

(12) United States Patent
Pommier

(10) Patent No.: US 11,261,609 B2
(45) Date of Patent: Mar. 1, 2022

(54) WIND UPLIFT RESISTANCE MECHANISM FOR OUTDOOR FLOORING

(71) Applicant: Magia Logistica Corporation, West Palm Beach, FL (US)

(72) Inventor: Mario Pommier, West Palm Beach, FL (US)

( * ) Notice: Subject to any disclaimer, the term of this patent is extended or adjusted under 35 U.S.C. 154(b) by 0 days.

(21) Appl. No.: 16/655,128

(22) Filed: Oct. 16, 2019

(65) Prior Publication Data

US 2020/0123786 A1 Apr. 23, 2020

Related U.S. Application Data

(60) Provisional application No. 62/746,947, filed on Oct. 17, 2018.

(51) Int. Cl.
*E04F 15/02* (2006.01)
*E04F 15/024* (2006.01)
(Continued)

(52) U.S. Cl.
CPC ..... *E04F 15/02183* (2013.01); *E04F 15/022* (2013.01); *E04F 15/024* (2013.01); *E04F 15/02044* (2013.01); *E04F 15/02194* (2013.01); *E04F 15/02405* (2013.01); *E04F 15/02452* (2013.01); *E04F 15/082* (2013.01); *E04D 11/00* (2013.01); *E04D 11/005* (2013.01); *E04D 11/007* (2013.01); *E04F 15/0215* (2013.01);
(Continued)

(58) Field of Classification Search
CPC ..... E04F 15/02183; E04F 15/02452; E04F 15/024; E04F 15/02405; E04F 15/02194; E04F 15/02044; E04F 15/0215; E04F 2201/05; E04F 15/022; E04F 15/082; E04F 15/02464; E04D 11/00; E04D 11/005; E04D 11/007
USPC ..... 52/126.6, 263, 285.1–285.4, 390, 391, 52/506.01, 506.05, 582.1, 582.2, 583.1, 52/584.1, 587.1
See application file for complete search history.

(56) References Cited

U.S. PATENT DOCUMENTS 1,150,044 A * 8/1915 Leonard ..... E04B 5/023 52/583.1
1,682,210 A * 8/1928 Belrose ..... A47B 13/08 52/582.1
(Continued)

FOREIGN PATENT DOCUMENTS

CA 2843068 A1 * 8/2014 ..... E04F 15/02458
CH 681644 A5 * 4/1993 ..... E04F 15/087
(Continued)

OTHER PUBLICATIONS

International Search Report and Written Opinion for International Application No. PCT/US2019/056802, dated Jan. 10, 2020, 13 pages.

*Primary Examiner* — Robert Canfield
(74) *Attorney, Agent, or Firm* — Stoel Rives LLP

(57) ABSTRACT

The disclosure relates to an outdoor flooring assembly for securing flooring trays to improve stability and wind uplift resistance. The flooring trays each include a plurality of securement mechanisms coupled to a bottom surface thereto, the securement mechanisms designed to interconnect with one another to securely retain adjacent trays together and minimize the risk that any individual tray is dislodged.

20 Claims, 9 Drawing Sheets

(51) Int. Cl.
*E04F 15/08* (2006.01)
*E04F 15/022* (2006.01)
*E04D 11/00* (2006.01)

(52) U.S. Cl.
CPC ... *E04F 15/02138* (2013.01); *E04F 15/02464* (2013.01)

(56) References Cited

U.S. PATENT DOCUMENTS 1,710,610 A * 4/1929 Duke ..... E04F 15/022 52/489.1
1,807,630 A * 6/1931 McFarlin ..... E04F 13/142 52/391
1,918,228 A * 7/1933 Spencer ..... E04F 13/12 52/391
2,136,431 A * 11/1938 Gardaile ..... E04F 13/04 52/447
2,822,585 A * 2/1958 Baruch ..... E04H 3/10 52/582.1
2,829,018 A * 4/1958 Valtri ..... A47B 1/10 52/582.2
3,141,392 A * 7/1964 Schneider ..... E04F 15/06 52/582.2
3,780,480 A * 12/1973 Cvijanovic ..... E04B 1/215 52/223.4
4,538,392 A 9/1985 Hamar et al.
5,323,575 A 6/1994 Yeh
6,032,425 A * 3/2000 Gugliotti ..... E04F 15/04 52/480
6,032,427 A * 3/2000 Randjelovic ..... E04F 15/04 52/403.1
6,468,616 B1 * 10/2002 Bristow ..... F16B 12/125 428/61
6,575,660 B1 6/2003 Davis et al.
6,694,691 B2 * 2/2004 Ku ..... E01C 5/223 52/403.1
6,851,236 B1 2/2005 Harvey
7,162,838 B2 * 1/2007 Ardern ..... E01C 5/22 52/127.9
8,146,317 B1 * 4/2012 Fletcher ..... E04F 15/02183 52/582.2
8,291,661 B2 * 10/2012 Bengry ..... E04F 15/02 52/392
8,631,624 B2 1/2014 McIntosh et al.
8,850,753 B2 10/2014 Tabibnia
9,038,341 B2 5/2015 Lam et al.
9,416,548 B2 8/2016 Tang
9,822,533 B2 * 11/2017 Huang ..... E04B 5/02
9,982,439 B2 5/2018 Essig
10,113,320 B1 * 10/2018 Cataldi ..... E04F 15/02464
2003/0041542 A1 3/2003 Martin
2003/0136070 A1 * 7/2003 Ku ..... E04F 15/041 52/403.1
2005/0193675 A1 * 9/2005 Smart ..... E01C 9/08 52/578
2005/0214077 A1 * 9/2005 DeArmond ..... E04H 13/003 405/284
2007/0094969 A1 * 5/2007 McIntosh ..... E04F 15/0215 52/386
2009/0139159 A1 6/2009 Hill
2010/0257801 A1 * 10/2010 Anderson ..... E04F 15/105 52/391
2010/0313509 A1 * 12/2010 McIntosh ..... E04F 15/087 52/385
2011/0120037 A1 * 5/2011 Barlow ..... E04F 15/02194 52/309.1
2017/0260699 A1 * 9/2017 Tabibnia ..... E04F 15/02452
2017/0260754 A1 * 9/2017 Kugler ..... E04D 11/007

FOREIGN PATENT DOCUMENTS

FR 2487407 A2 * 1/1982 ..... E04F 15/02194
GB 902259 A * 8/1962 ..... E01C 5/005
JP 05051992 A * 3/1993

* cited by examiner

WIND UPLIFT RESISTANCE MECHANISM FOR OUTDOOR FLOORING

RELATED APPLICATION DATA

This application is a nonprovisional of and claims the benefit under 35 U.S.C. § 119(e) of U.S. Provisional Patent Application No. 62/746,947, filed Oct. 17, 2018, the disclosure of which is incorporated by reference herein in its entirety.

TECHNICAL FIELD

The field of this disclosure relates generally to outdoor flooring systems, and in particular, to mechanisms for such systems designed to secure the flooring and resist wind uplift forces, thereby increasing stability and strength of the flooring system.

BACKGROUND

Outdoor living spaces have grown in popularity over the last few decades in both private residences and in commercial buildings. Homeowners have increasingly sought to create outdoor spaces for entertainment and relaxation. Commercial buildings, such as office buildings, apartment complexes, and residential high-rises have increasingly used outdoor and rooftop spaces to create gardens, patios, bars, restaurants, and relaxation areas for tenants and as areas to generate business such as for bars and entertainment.

As the popularity of outdoor spaces has continued growing, so too has the variety of materials employed for outdoor use. In more recent times, there has been a gradual shift from using primarily wood or concrete attached to the structure of the roof to create stable flooring for outdoor spaces, toward using individual pavers (such as tiles and stones) to create more aesthetically pleasing and unique flooring patterns. In one arrangement, individual pavers are aligned edge-to-edge with little or no space between them to create a desired pattern, where the pavers may be loose laid on elevated pedestals, which are in turn also loose laid on the subflooring or ground. With loose-laid pavers, each paver rests on a portion of the pedestal without adhesives or additional anchoring. This technique may provide some advantages on a roof deck or balcony when used. For example, a finished water-proofing membrane may be installed on the concrete surface and then the modular pavers may be loose-laid on the pedestals to allow for paver removal as needed when maintenance of the membrane or upgrades such as lighting and power conduits are done. However, typically, the weight of the pavers is the only mechanism that ensures the pavers remain stable on the pedestals during extreme events, such as high velocity winds during hurricanes, or ground movement during earthquakes, which may present certain failure points.

During certain wind conditions, such as hurricanes and storms, pressure distributions may be created where the pressure or force acting downwardly on the paver is exceeded by the pressure or force acting upwardly on the paver, thereby creating a net uplift force on the paver. Typically, the weight of the paver is sufficient to counteract the uplift force so as to maintain the paver securely in position. However, as the uplift force increases during extreme wind conditions, it can cause the paver to vibrate and/or entirely dislodge from the pedestal, which not only creates potentially destructive flying debris, but also leaves the roof or other subsurface exposed to rain, debris, or other potentially damaging external conditions.

Existing mechanical wind uplift resistance mechanisms rely on attempting to secure the pavers to the pedestals via a washer/screw combination mechanism. While this arrangement may provide some stability to the pavers, it does not provide significant resistance because there is no mechanical attachment between the individual pavers, the screw/washer, and the pedestal. This weakness renders the overall mechanism rather ineffective, as evidenced by wind uplift tests and common real life examples of loose pavers causing damage. Furthermore, relying on the pedestal as a point of connection requires securing the pedestal to the roof's rubber membrane, which tends to create a second failure point of this system.

Accordingly, the present inventor has identified a need for a mechanism designed to resist wind uplift and securely retain pavers in position without reliance on attachment of the pavers to pedestals. As further described in detail below, the mechanism is designed such that the pavers are relatively easy to install and uninstall, the mechanism being effective at dissipating uplift forces to minimize risk of paver dislodgement. Additional aspects and advantages will be apparent from the following detailed description of example embodiments, which proceeds with reference to the accompanying drawings.

DETAILED DESCRIPTION OF EXAMPLE EMBODIMENTS

With reference to the drawings, this section describes particular embodiments of systems and methods relating to interconnecting outdoor flooring trays for improved wind performance and uplift resistance. Throughout the specification, reference to "one embodiment," "an embodiment," or "some embodiments" means that a particular described feature, structure, or characteristic may be included in at least one embodiment of the described system. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

FIGS. 1-16 collectively illustrate various embodiments of an outdoor flooring tray assembly and tray interconnection mechanism for securing floor trays/tiles. As further detailed below, the system is designed to improve stability and wind uplift resistance to minimize potential tray dislodgement due to storms or other weather conditions. With general reference to FIGS. 1-3, the following briefly describes an overview of one example tray interconnection mechanism for context, with further details of this and other embodiments provided in the following sections.

Figure 1:
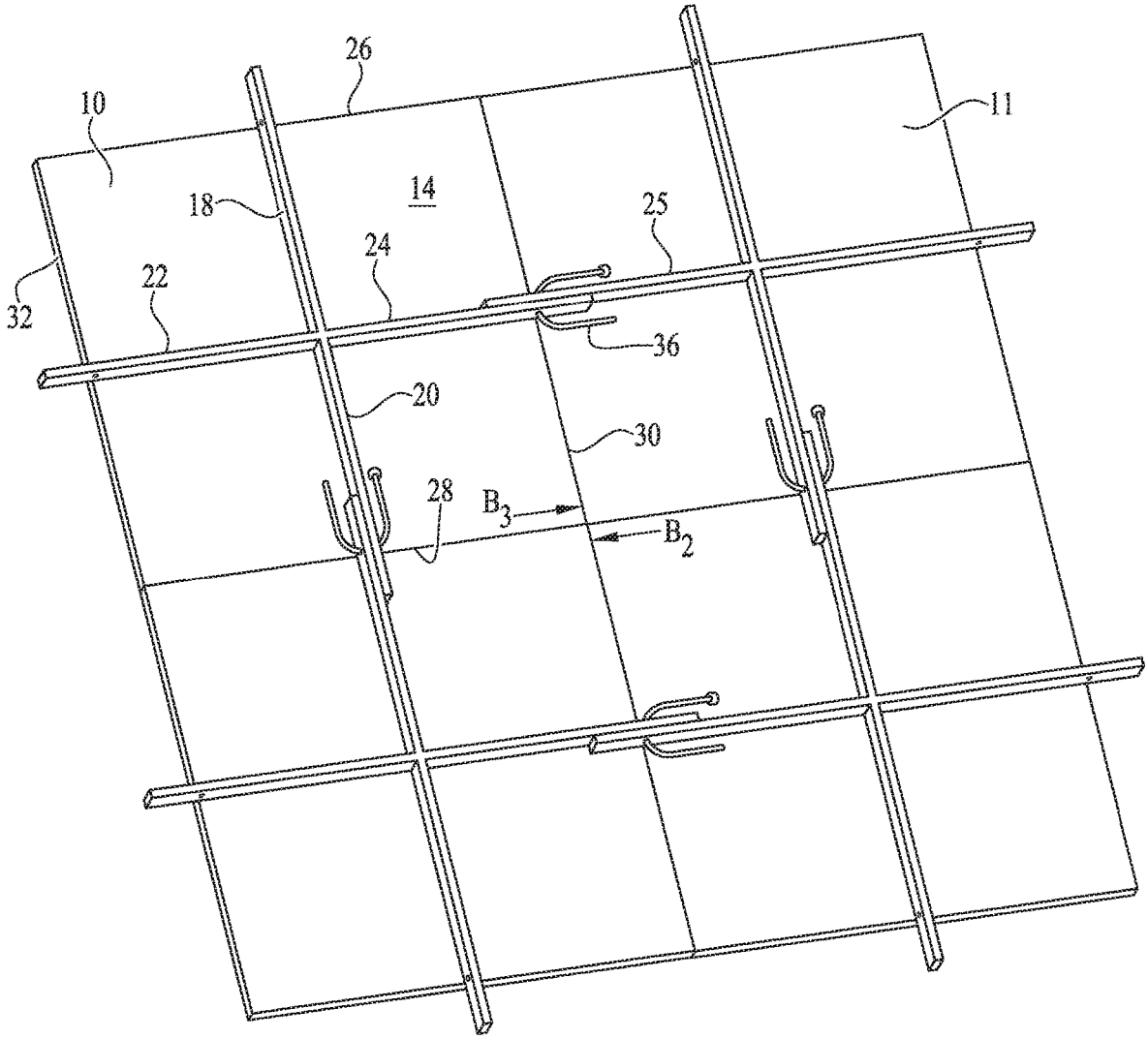
FIG. 1 illustrates a bottom view of a plurality of interconnected flooring trays in accordance with one embodiment.
Figure 2:
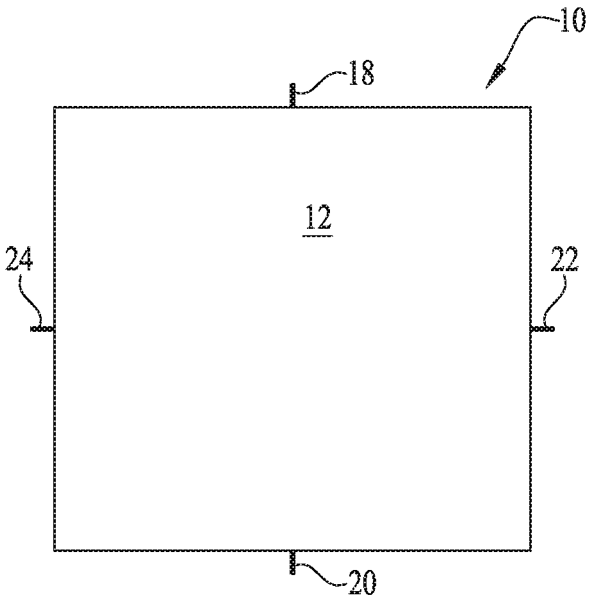
FIGS. 2 and 3 are schematic top and bottom views of one of the flooring trays of FIG. 1.
Figure 3:
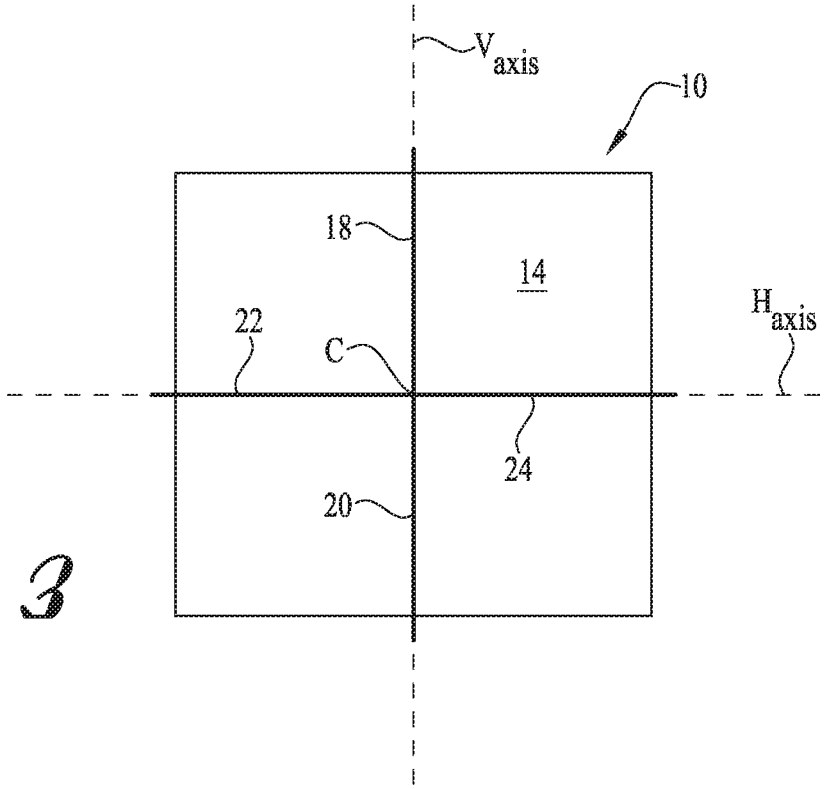

FIGS. 1-3 collectively illustrate one embodiment of flooring tray 10 that forms an outdoor flooring system. As illustrated in FIGS. 1-3, the flooring tray 10 includes a tray support system formed along a bottom surface 14 of the tray 10. The tray support system includes a pair of leg segments 18, 20 aligned relative to one another along a vertical axis V crossing a midpoint C of the tray 10 (see FIG. 3). The tray support further includes another pair of leg segments 22, 24 aligned with one another along a horizontal axis H that is perpendicular to and crosses the vertical axis V at the midpoint C. In other words, the leg segments 18, 20, 22, 24 each extend outwardly from the midpoint C toward a respective edge of the flooring tray 10, thereby dividing the bottom surface 14 of the tray 10 into four generally equal quadrants as illustrated in FIG. 1.

With general reference to FIG. 1, the first leg segment 18 extends from midpoint C along the vertical axis V and terminates beyond a first peripheral boundary or edge 26 of the tray 10. Similarly, the second leg segment 20 extends from midpoint C along the vertical axis V and terminates beyond a second peripheral boundary or edge 28 of the tray 10; the third leg segment 22 extends from midpoint C along the horizontal axis H and terminates beyond a third peripheral boundary or edge 32 of the tray 10; and the fourth leg segment 24 extends from midpoint C along the horizontal axis V and terminates beyond a fourth peripheral boundary or edge 30 of the tray 10. The leg segments 22, 24 each include an opening 34 formed adjacent an end thereof, where the opening 34 is generally aligned with or offset from and positioned along a portion of the respective leg segments 22, 24 that is beyond the respective boundary or edges of the tray 10 (see FIG. 4). It is noted that although details for the other two leg segments 18, 20 are not shown in FIG. 4, they also include a corresponding opening arranged in a similar fashion as described with respect to leg segments 22, 24.

Figure 6:
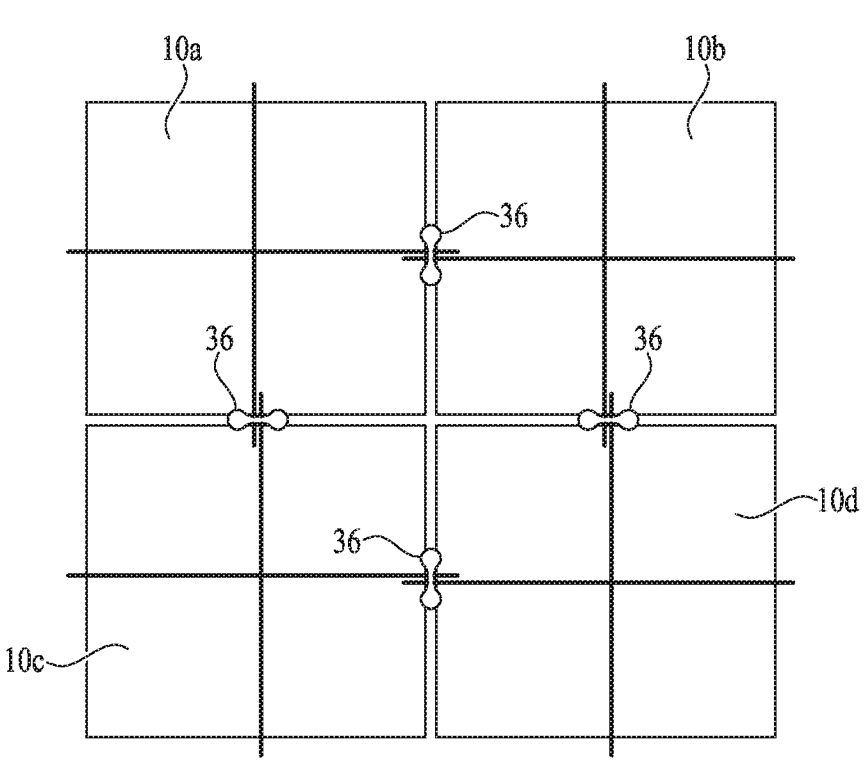
FIG. 6 is a schematic bottom view illustrating an interconnected flooring assembly in accordance with one embodiment.

Returning to FIG. 1, to connect adjacent trays 10, 11 to one another, the adjacent leg segments 24, 25 are arranged such that the respective openings 34 are aligned with one another. Once aligned, a fastener 36, such as a pin, hook, or other suitable fastener, is inserted through the aligned openings 34 of the respective leg segments 24, 25 to interconnect adjacent trays 10, 11. A similar process may be used to interconnect all trays 10 to one another (or to form smaller subsets of trays connected to one another) as illustrated in FIG. 6. With the trays connected to each other, the system minimizes the risk of dislodging for any individual tray 10 because any uplift force exerted on one tray is counteracted by all trays 10 connected to it. In some embodiments, the trays 10 may be further stabilized by attachment to a wall, parapet, or other structure. Additional details of these and other embodiments relating to the system and its components are described in further detail below with reference to the figures.

FIGS. 1-3 illustrate various views of a flooring tray 10 in accordance with one embodiment. With collective reference to FIG. 1-3, the flooring tray 10 includes a top surface 12 and an opposite bottom surface 14. In some embodiments, the top surface 12 may be substantially planar, but it can also include ridges or other features designed for supporting a variety of suitable flooring tiles or surfaces as further described below with reference to FIGS. 15-16. The flooring tray 10 may have a generally square-shaped profile with peripheral edges 26, 28, 30, 32 forming the boundaries of the flooring tray 10 in the embodiment of FIG. 1. It should be understood that the flooring tray 10 may have any other suitable shapes as desired without departing from the principles of the disclosed subject matter.

Figure 4:
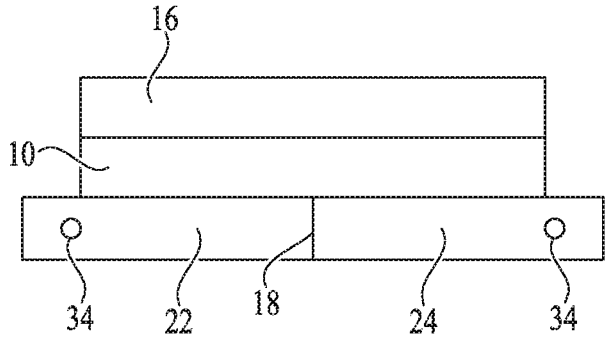
FIG. 4 is a schematic side view of a flooring tray with a paver or flooring tile attached thereto in accordance with one embodiment.

The top surface 12 of the flooring tray 10 supports a flooring tile 16 that may be adhesively secured or coupled thereto via other suitable means (see FIG. 4). The flooring tile 16 may comprise any suitable material, such as porcelain, ceramic, wood, stone, turf, carpet, or other suitable material to satisfy the desired aesthetic design of the flooring.

Turning in particular to FIGS. 1 and 3, the bottom surface 14 of the flooring tray 10 includes a plurality of leg segments 18, 20, 22, 24 disposed thereon. The leg segments 18, 20, 22, 24 are each raised or extend away from the bottom surface 14 of the tray 10, where the leg segments 18, 20, 22, 24 are arranged in a generally crossing pattern as illustrated. For example, with particular reference to FIG. 3, the leg segments 18, 20 are aligned relative to one another along a vertical axis V extending through a center point C of the bottom surface 14, and the leg segments 22, 24 are aligned relative to one another along a horizontal axis H extending through the center point C. As described, the bottom surface 14 of the flooring tray 10 is separated into four relatively equal quadrants by the leg segments 18, 20, 22, 24. The flooring tray 10 and leg segments 18, 20, 22, 24 may be made of fiberglass in one embodiment, though other suitable materials may be used as well in other embodiments. It should be understood that while both the leg segments 18, 20 and leg segments 22, 24 are each illustrated and described as separate segments crossing over at center point C, in other embodiments, one or both pairs of leg segments may be formed as single, unitary legs that cross one another at the center point C.

As illustrated in FIGS. 1-3, the leg segments 18, 20, 22, 24 each have a length designed to allow a portion of the respective leg segment 18, 20, 22, 24 to extend beyond a respective peripheral edge or boundary of the flooring tray 10. For example, with reference to FIG. 1, the leg segment 18 extends from the center point C beyond the peripheral edge 26 of the flooring tray 10. Similarly, the leg segment 20 extends from the center point C beyond the peripheral edge 28, the leg segment 22 extends from the center point C beyond the peripheral edge 30, and leg segment 24 extends from the center point C beyond the peripheral edge 32 as previously described. This extension of the leg segments 18, 20, 22, 24 beyond the peripheral boundaries of the flooring tray 10 helps support a connection mechanism as further described below with reference to FIG. 4.

FIG. 4 is a schematic illustration of a side view of the flooring tray 10. As illustrated, the leg segments 22, 24 extend underneath the flooring tray 10, and a selected flooring tile 16 is supported by the flooring tray 10. With reference to FIG. 4, the leg segments 22, 24 each include an opening 34 formed along an end thereof, the opening 34 extending transversely through the leg segments 22, 24. Although not illustrated in the view of FIG. 4, it should be understood that the other leg segments 18, 20 of the flooring tray 10 also include a similar opening (not shown) formed at a similar position as noted previously.

Figure 5:
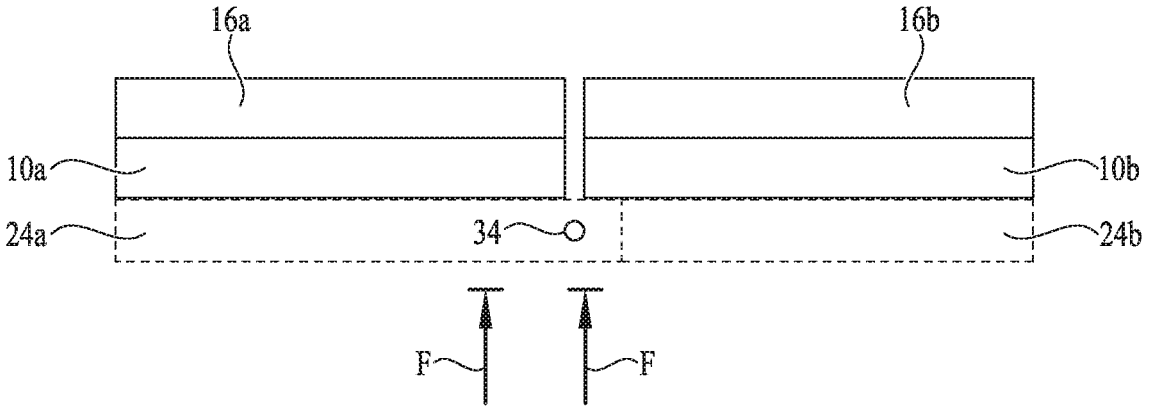
FIG. 5 is a schematic side view of two interconnected flooring trays in accordance with one embodiment.

FIG. 5 is a side view of a pair of interconnected flooring trays 10*a*, 10*b* in accordance with one embodiment. With collective reference to both FIGS. 1 and 5, the following describes details for an interconnection mechanism designed to improve wind uplift resistance for the outdoor flooring system. To connect the trays 10*a*, 10*b* to one another, the trays 10*a*, 10*b* are arranged such that the corresponding leg segments 24*a*, 24*b* are generally aligned relative to one another, with a portion of the leg segment 24*a* overlapping a corresponding portion of the leg segment 24*b*. When the leg segments 24*a*, 24*b* are properly positioned, the respective openings 34 on the ends of each segment 24*a*, 24*b* are aligned with one another. In some embodiments, the ends of the segments 24*a*, 24*b* may include a gradual inward taper to accommodate the leg segments 24*a*, 24*b* and allow for proper alignment of the flooring trays/tiles during installation. Once the leg segments 24*a*, 24*b* are aligned, a pin 36 other suitable fastener (see FIG. 1) may be inserted through the openings 34 to secure leg segments 24*a*, 24*b* together. A similar process may be used to secure and interconnect other flooring trays 10 (see FIG. 1) via the various overlapping leg segments to form a completed flooring assembly with the desired length and width dimensions for the desired floor plan.

FIG. 6 is a schematic bottom view illustrating an example embodiment of a flooring assembly 38 including a plurality of interconnected trays 10*a*, 10*b*, 10*c*, 10*d*. As illustrated, all trays 10*a*, 10*b*, 10*c*, 10*d* are interconnected to one another via the pins 36 as described above. In this arrangement, the trays 10*a*, 10*b*, 10*c*, 10*d* act as a unified field designed to counteract any wind uplift forces, which are represented by the arrow F (see FIG. 5). In other words, any wind uplift forces F that may be exerted against any individual tray 10 or subset of trays 10 are dissipated across the entire flooring assembly 38, thereby drastically minimizing the risk that any individual or subset of trays may become dislodged. As described previously, this arrangement of interconnecting the trays 10*a*, 10*b*, 10*c*, 10*d* reduces the likelihood that any individual tray will be dislodged by an applied uplift force F.

Figure 7:
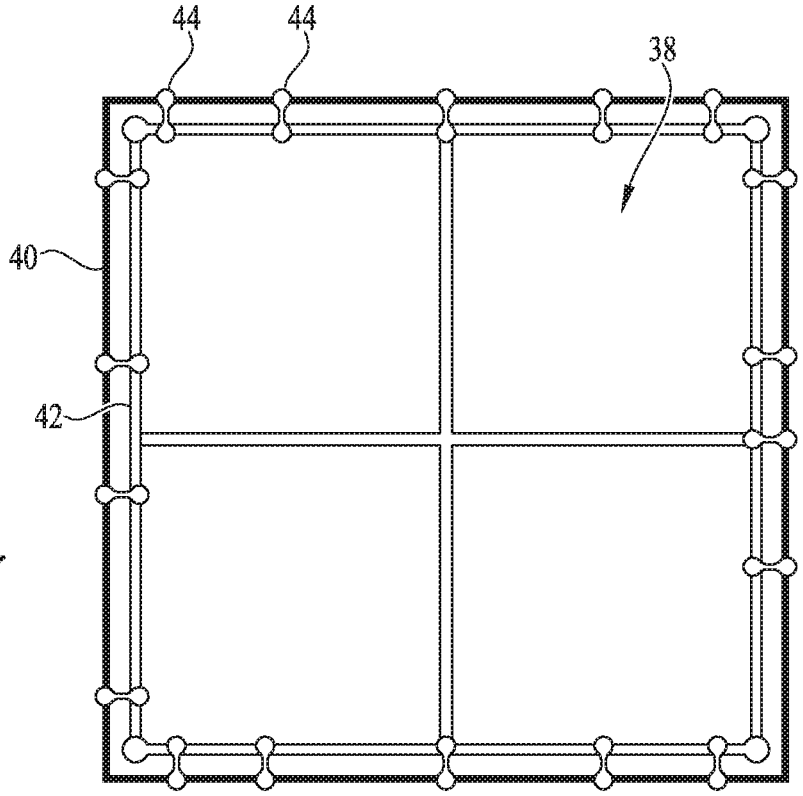
FIGS. 7 and 8 are schematic top and side views illustrating a securement mechanism for anchoring the flooring assembly in accordance with one embodiment.
Figure 8:
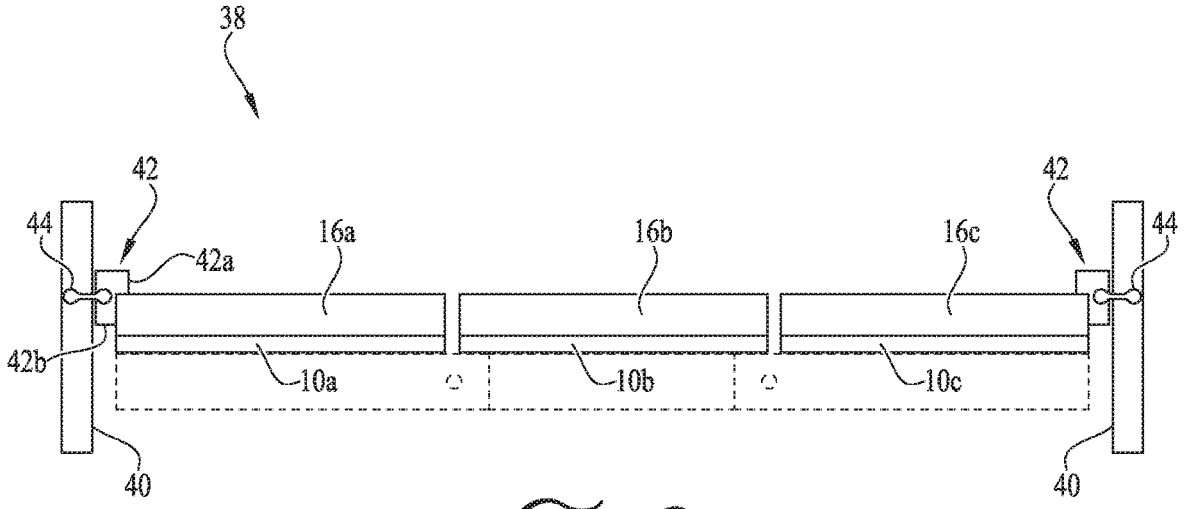

FIGS. 7 and 8 are example embodiments illustrating an additional securement mechanism to support the flooring assembly 38. With reference to FIG. 7, in one embodiment, the flooring assembly 38 may be secured to an exterior support surface 40, such as a wall, parapet, or other suitable structure via a supporting bracket 42 (e.g., an "L" bracket or angle iron). As illustrated, the supporting bracket 42 may be disposed along various points of the perimeter of the flooring assembly 38 as desired. The bracket 42 may operate as a cap to further secure the flooring assembly 38 to the support surface 40 via a plurality of fasteners 44. As designed, the bracket 42 operates as an additional wind uplift resistant point on which the flooring assembly 38 may ultimately rely to resist heavy wind uplift forces.

FIG. 8 illustrates a side view of the securement system described above with reference FIG. 7. As illustrated in FIG. 8, each of the trays 10*a*, 10*b*, 10*c* supports a corresponding tile 16*a*, 16*b*, 16*c* (as described previously with reference to FIG. 4). The trays 10*a*, 10*b*, 10*c* are interconnected together as described previously, where tray 10*a* is connected directly to tray 10*b*, and tray 10*b* is connected directly to tray 10*c* via a pin 36 or other suitable fasteners. In this arrangement, if tray 10*b* were to experience significant wind uplift forces, trays 10*a* and 10*c* would work together with tray 10*b* to resist the uplift force. Because of their interconnection, the trays 10*a*, 10*b*, 10*c* operate as a single unit to resist the force, thereby reducing the likelihood of any tray dislodgement.

As described with reference to FIG. 7, the bracket 42 provides further support for the flooring assembly 38. As illustrated, in one embodiment, the bracket 42 is an L-shaped bracket including a first leg 42*a* and a second leg 42*b*. In an assembled configuration, the first leg 42*a* extend over and rests against a portion of the top surface of each of the tiles 16 positioned along the boundary of the flooring assembly 38 (e.g., tiles 16*a* and 16*c* in FIG. 8). In this configuration, the second leg 42*b* of the bracket 42 is attached to the support surface 40 via the fastener 44. Returning to the previous example, in this configuration, if tray 10*b* were to experience extreme wind uplift force such that it would ordinarily overcome the combined effort of trays 10*a*, 10*b*, 10*c*, the bracket 42 and fastener 44 would help support trays 10*a*, 10*b*, 10*c* and resist dislodgement of all trays.

Figure 9:
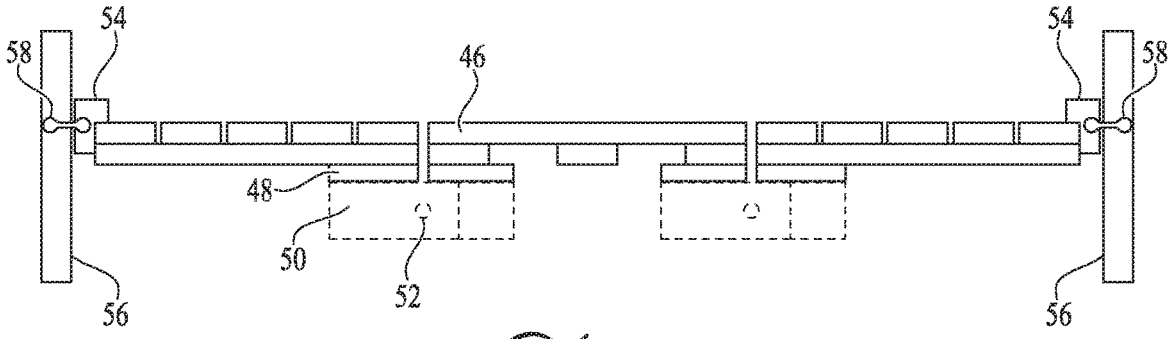
FIG. 9 is a schematic side view illustrating another embodiment of a securement mechanism for anchoring the flooring assembly.

As described, FIGS. 1-8 may be used in connection with a variety of tiles, such as porcelain, ceramic, or stone, where each tile is supported by an individual tray. In other embodiments, such as illustrated in FIG. 9, the tray interconnection concept may be adapted to support tiles made of different materials, such as wood or wood composite. With reference to FIG. 9, the following briefly describes one such embodiment.

As illustrated in FIG. 9, in one embodiment, wooden tiles 46, typically composed of two layers of wooden boards coupled together, may be attached to a bracket 48 via screws. As illustrated, a tile support bracket 48 may not extend entirely underneath the wooden tile 46 since such additional support may not be necessary for wooden tiles 46. The bracket 48 may include leg segments 50 having an opening 52 formed on an end thereof in a similar arrangement as described previously with respect to the embodiments of FIGS. 1-4. The brackets 48 may be interconnected via pins or other fasteners (not shown) extending through the openings 52 in a similar fashion as described previously. Once the tile support brackets 48 are interconnected, a supporting bracket 54 may be used to further support the wooden tiles 46 around the periphery of the assembly and connect the assembly to a wall or other support structure 56 via fasteners 58. In a similar fashion as described previously, this arrangement of interconnected support brackets 48 aids in dissipating wind uplift forces to ensure that the wooden tiles 46 remain in place.

Figure 10:
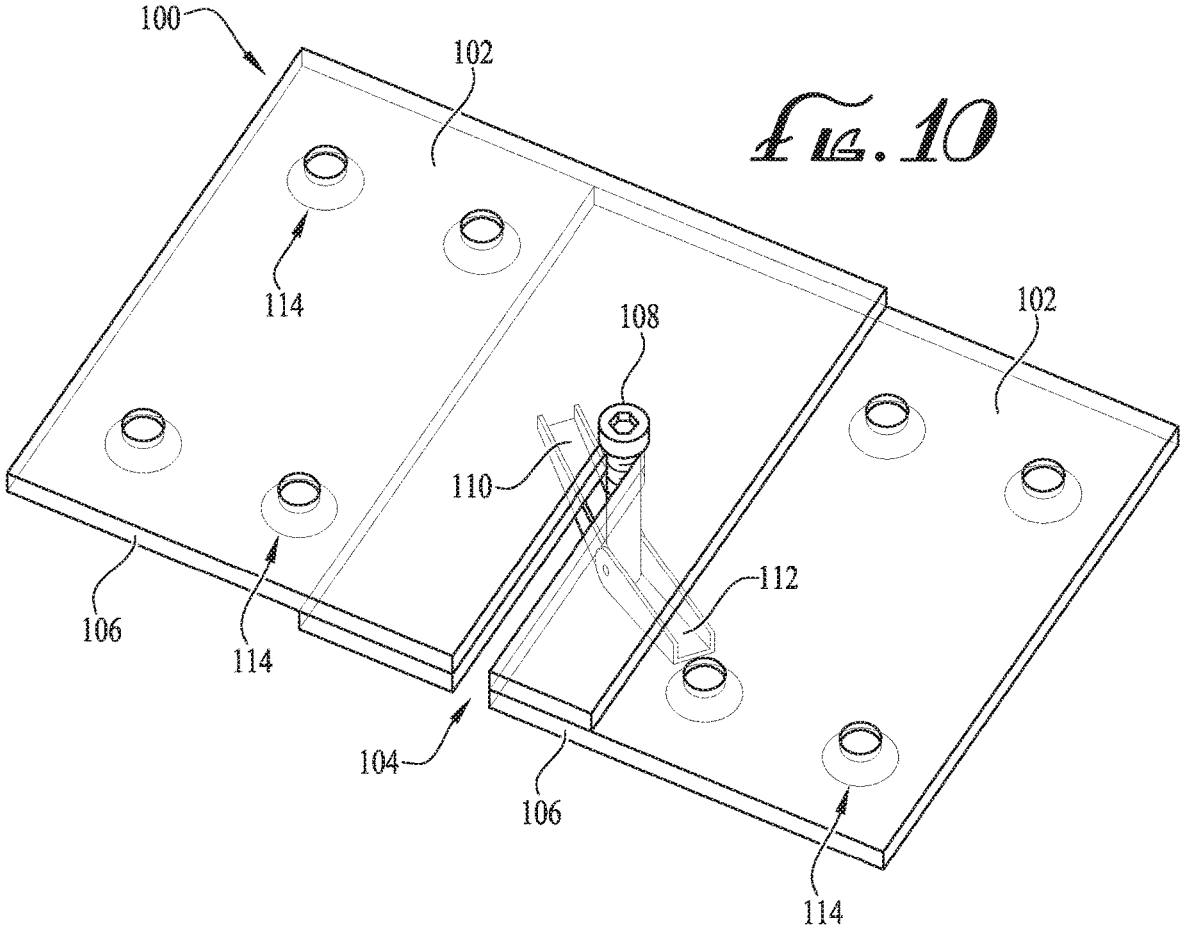
FIG. 10 illustrates yet another example embodiment of a connection mechanism for securing flooring trays to one another.

FIG. 10 illustrates yet another example embodiment of a connection mechanism for securing flooring trays to one another. With reference to FIG. 10, each bracket 100 includes a generally rectangular body 102 having a slot 104 formed thereon, wherein the slot 104 extends from one edge 106 of the body 102 toward a central portion of the frame 102. The body 102 further includes a plurality of openings or holes 114 formed thereon for attaching wood tiles (not shown) to the brackets 100 via fasteners (not shown) inserted through the holes 114. In an assembled configuration, the brackets 100 are brought together such that a portion of each bracket 100 overlaps an adjacent bracket as illustrated in FIG. 10. When the brackets 100 are properly arranged, the respective slots 104 are aligned relative to one another as illustrated in FIG. 10. Thereafter, a fastener 108 is inserted into the slots 104, the fastener 108 include a pair of legs 110, 112, each extending outwardly from the central portion of the fastener 108 to form a generally T-shaped fastener. In this configuration, the legs 110, 112 of the T-shaped fastener 108 help connect the brackets 100 to one another, with the legs 110, 112 supported against the bottom surface of the brackets 100 to optimize wind uplift resistance in a similar fashion as described previously with reference to the embodiments of FIGS. 1-4.

In some embodiments, the brackets 100 may not incorporate the openings 114, such as when the brackets 100 are used with porcelain or other similar tiles. Since fasteners cannot easily be inserted into porcelain or other similar tiles, the brackets 100 may instead be formed as integral components of a tray (not shown), which may be adhesively attached to the porcelain tile.

Figure 11:
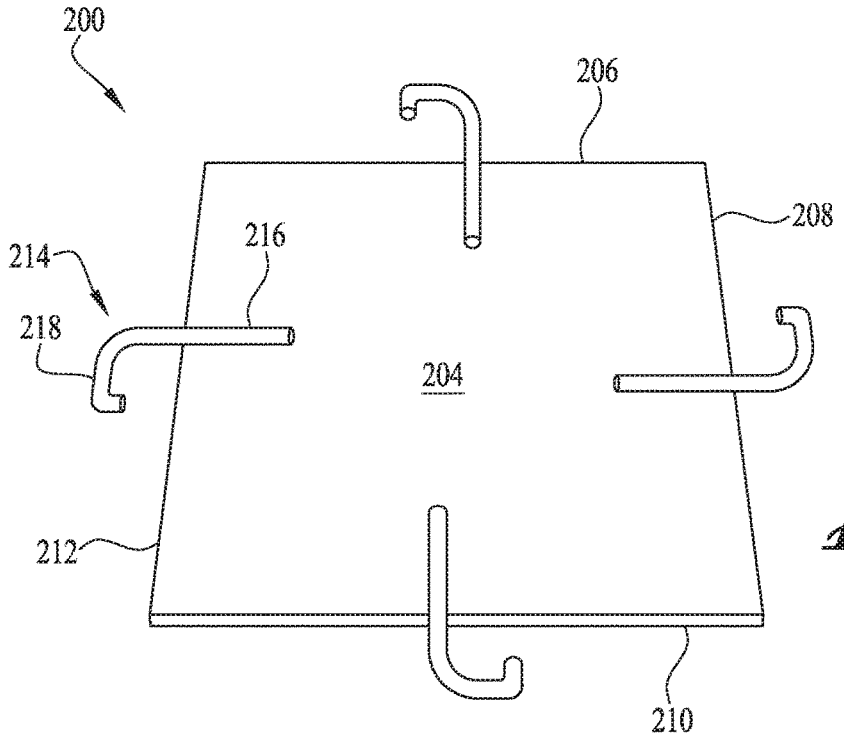
FIG. 11 illustrates a bottom view of a flooring tray in accordance with another embodiment.
Figure 12:
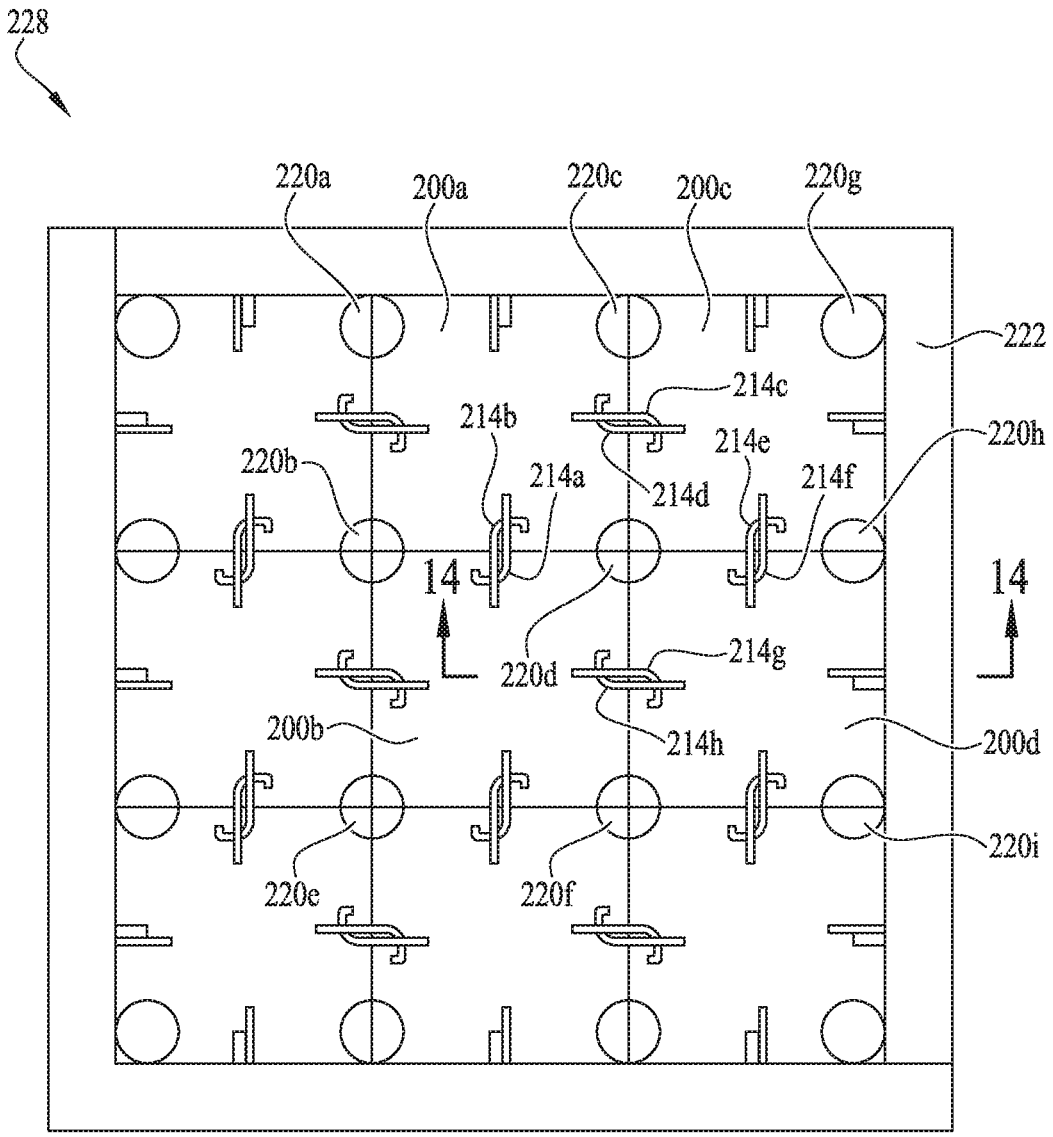
FIGS. 12 and 13 are schematic top and bottom views of a plurality of interconnected flooring trays in accordance with the embodiment of FIG. 11.
Figure 13:
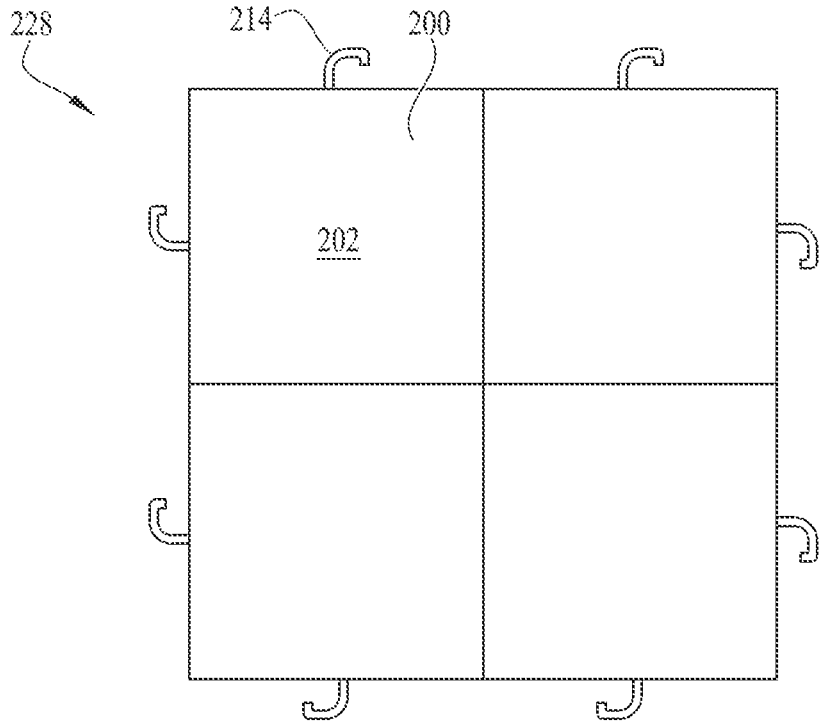

FIGS. 11-13 illustrate various views of a flooring tray 200 in accordance with yet another embodiment. With reference to FIG. 11, the flooring tray 200 is similar to the flooring tray 10 of FIGS. 1-3. In particular, the flooring tray 200 includes a top surface 202 (see FIG. 13) and an opposite bottom surface 204. In some embodiments, the top surface 202 may be substantially planar, but it can also include ridges or other features designed for supporting a variety of suitable flooring tiles or surfaces as further described below with reference to FIGS. 15-16. The flooring tray 200 may have a generally square-shaped profile with peripheral edges 206, 208, 210, 212 forming the boundaries of the flooring tray 200. Similar to the embodiment of the flooring tray 10 of FIGS. 1-3, the top surface 202 of the flooring tray 200 is designed to support a flooring tile 201 (see FIG. 14) that may be adhesively secured or coupled thereto via other suitable means, where the flooring tile may comprise any suitable material to satisfy the desired aesthetic design of the flooring.

With reference to FIG. 11, the bottom surface 204 of the flooring tray 200 includes a plurality of securement hooks 214 coupled thereto for receiving and interconnecting a plurality of flooring trays 200 together. The securement hooks 214 each include a leg segment 216 and a hook portion 218, where some or all of the leg segment 216 is coupled to the bottom surface 204 of the flooring tray 200, and where the hook portion 218 is arranged such that it extends beyond the respective peripheral boundary of the flooring tray 200. For example, as illustrated in FIG. 11, the hook portion 218 extends beyond the peripheral edge 206. Preferably, the flooring tray 200 includes four hooks, one extending along each of the peripheral edges 206, 208, 210, 212 of the flooring tray 200. In other embodiments, the flooring tray 200 may include additional securement hooks as desired.

FIGS. 12 and 13 are schematic top and bottom views illustrating a flooring assembly 228 including a plurality of interconnected flooring trays 200 in accordance with one embodiment. With reference to FIG. 12, to connect flooring trays 200 to one another, the respective hook portions 218 of the flooring trays 200 are brought together and mated such that a hook portion 218 of one flooring tray 200 engages a leg segment 216 of an adjacent flooring tray 200, and vice versa as illustrated in FIG. 12. This installation method may be accomplished in various suitable ways. One such method is further described below.

With particular reference to FIG. 12, in one installation method, a first flooring tray 200*a* is laid down on four pedestals 220*a*, 220*b*, 220*c*, 220*d*, with each of the four corners of the flooring tray 200*a* supported by a respective pedestal 220. Thereafter, a second flooring tray 200*b* is positioned adjacent and moved toward the first flooring tray 200*a*, such that the hook portions 218*a*, 218*b* of the respective securement hooks 214 engage one another. Once the hook portions 218*a*, 218*b* are engaged, the second flooring tray 200*b* is moved toward the first flooring tray 200*a* until the peripheral edges of the respective trays 200*a*, 200*b* contact one another, and the corners of the flooring tray 200*b* rest on the pedestals 220*b*, 220*d*. Thereafter, the pedestals 220*e*, 220*f* are positioned underneath the second flooring tray 200*b* for support.

Third flooring tray 200*c* is then interconnected with first flooring tray 200*a* by engaging hook portions 218*c*, 218*d* in a similar fashion as described above. Once the hook portions 218*c*, 218*d* are interconnected, the third flooring tray 200*c* is moved toward the first flooring tray 200*a* until the corners of the third flooring tray 200*c* are supported by the pedestals 220*c*, 220*d*. Thereafter, the pedestals 220*g*, 220*h* are positioned underneath the third flooring tray 200*c* for support.

Finally, the fourth flooring tray 200*d* is interconnected with the second and third flooring trays 200*b*, 200*c*. To connect the fourth flooring tray 200*d*, it may first be angled such that the flooring tray 200*d* is oriented generally diagonally when the hook portion 218*e* begins engaging with hook portion 218*f*. The fourth flooring tray 200*d* may then be slightly rotated to allow hook portions 218*g*, 218*h* to engage one another while maintaining the hook portions 218*e*, 218*f* engaged. Slight adjustments may be needed until the fourth flooring tray 200*d* is substantially flat on the pedestal 220*d*. Thereafter, pedestals 220*h*, 220*i*, 220*f* may be adjusted as needed to support the fourth flooring tray 200*d*. A similar installation process may continue until all the flooring trays 200 are interconnected with one another as desired.

Figure 14:
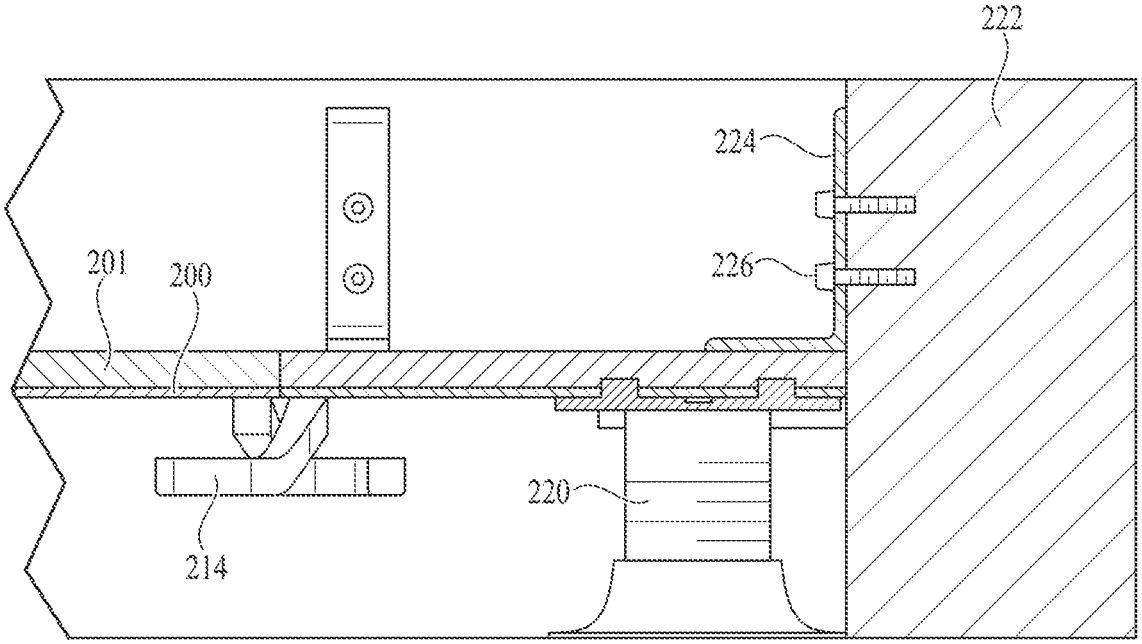
FIG. 14 is a cross-section view illustrating features of a securement mechanism for anchoring the flooring assembly in accordance with one embodiment.

Once the flooring trays 200 and flooring tiles 201 are fully assembled, the edges of the flooring assembly 228 may be attached to a wall structure 222 to provide an additional securement mechanism. For example, FIG. 14 illustrates a cross-section view of one example securement mechanism. With reference to FIG. 14, an L-shaped bracket 224 may be used to attach a flooring tray 200 and flooring tile 201 to the wall structure 222 in a similar fashion as described with reference to FIGS. 7-8. The bracket 224 may operate as a cap to further secure the flooring assembly to the wall structure 222 via a plurality of fasteners 226. As designed, the bracket 224 operates as an additional wind uplift resistant point on which the flooring assembly 228 may ultimately rely to resist heavy wind uplift forces.

Figure 15:
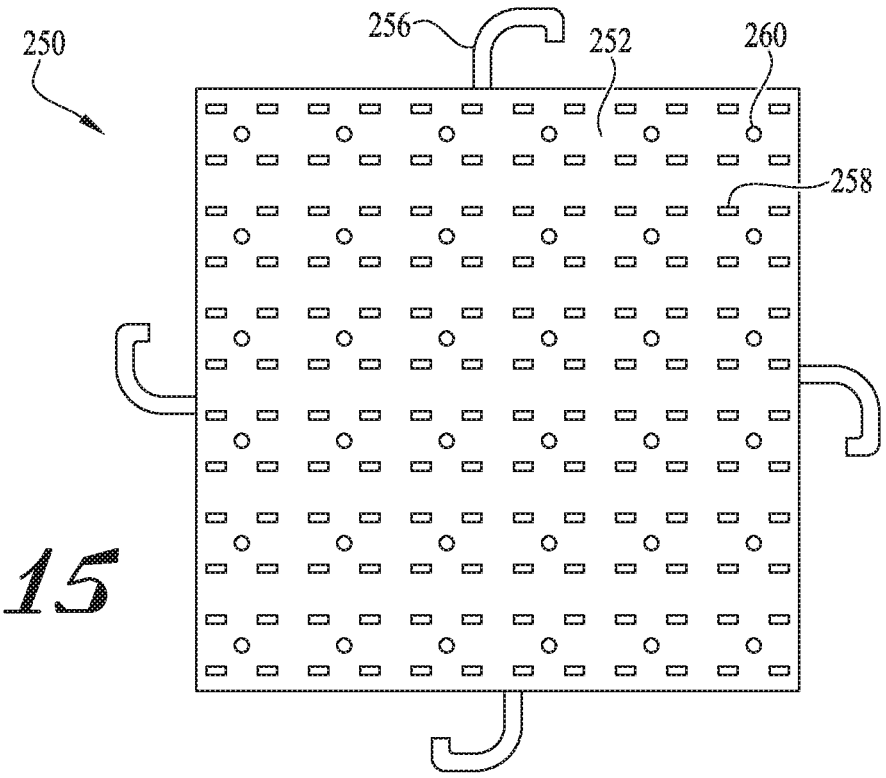
FIGS. 15 and 16 illustrate top and bottom views of a flooring tray in accordance with yet another embodiment.
Figure 16:
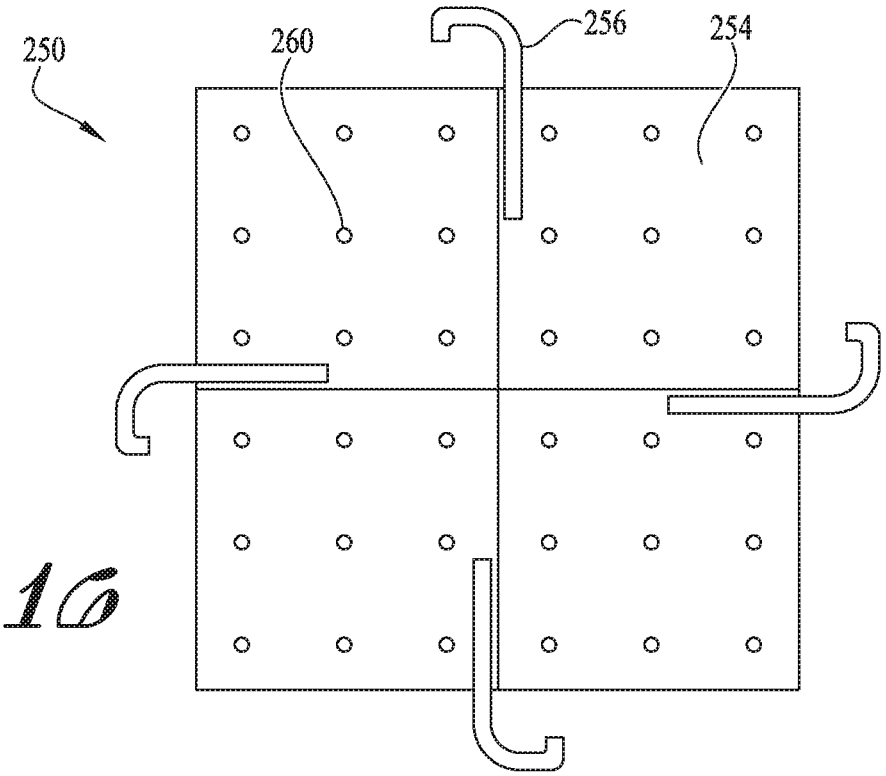

FIGS. 15 and 16 illustrate top and bottom views of a flooring tray 250 in accordance with yet another embodiment. The flooring tray 250 includes similar features as the flooring tray 200 described previously with reference to FIG. 11. Briefly, the flooring tray 250 includes a top surface 252 and an opposite bottom surface 254, where the bottom surface 254 includes a plurality of securement hooks 256 disposed thereon in a similar arrangement as described previously. The following description focuses primarily on differences between the embodiment of the flooring tray 250 as compared to the flooring tray 200, with the understanding that the other features and components not described herein may be substantially the same as described previously.

With particular reference to FIG. 15, the top surface 252 of the flooring tray 250 includes a plurality of raised protuberances 258 distributed along the top surface 252 to provide additional surfaces to help improve adhesion or securement of a tile or surface material (not shown) positioned thereon, such as turf or carpet. The flooring tray 250 further includes a plurality of openings 260 formed thereon and extending from the top surface 252 through to the bottom surface 252, the openings 260 providing drain ports for water management of the flooring assembly. While such embodiments may be used with a tile surface of any suitable material, the openings 260 may be beneficial when used with more absorbent materials, such as turf, carpet, or soil for plants/grass on a green roof application, to provide adequate drainage for any absorbed water.

It is intended that subject matter disclosed in particular portions herein can be combined with the subject matter of one or more of other portions herein as long as such combinations are not mutually exclusive or inoperable. In addition, many variations, enhancements and modifications of the concepts described herein are possible. The terms and descriptions used above are set forth by way of illustration only and are not meant as limitations. Those skilled in the art will recognize that many variations can be made to the details of the above-described embodiments without departing from the underlying principles of the invention.

The invention claimed is:

1. A flooring assembly comprising:

a first flooring tray including a top surface and an opposite bottom surface, a header edge and an opposite footer edge, and a first peripheral side edge and an opposite second peripheral side edge;

a first securement mechanism including a first leg portion and a first curved hook portion extending from an end of the first leg portion, wherein the first leg portion is coupled to the bottom surface of the first flooring tray, and wherein the first curved hook portion extends outwardly from the bottom surface beyond the footer edge of the first flooring tray;

a first pedestal supporting the first flooring tray along the header edge and first peripheral side edge, a second pedestal supporting the first flooring tray along the first peripheral side edge and the footer edge, a third pedestal supporting the first flooring tray along the footer edge and the second peripheral side edge, and a fourth pedestal supporting the first flooring tray along the second peripheral side edge and the header edge;

a second flooring tray including a top surface and an opposite bottom surface, a header edge and an opposite footer edge, and a first peripheral side edge and an opposite second peripheral side edge; and a second securement mechanism including a second leg portion and a second curved hook portion extending from an end of the second leg portion, wherein the second leg portion is coupled to the bottom surface of the second flooring tray, and wherein the second curved hook portion extends outwardly from the bottom surface beyond the header edge of the second flooring tray, wherein at least a portion of the first securement mechanism overlaps and interlocks with at least a portion of the second securement mechanism to secure the first and second flooring trays together and restrain movement along a vertical axis of the first and second flooring trays.

2. The flooring assembly of claim 1, further comprising:

a third flooring tray including a top surface and an opposite bottom surface, a header edge and an opposite footer edge, and a first peripheral side edge and an opposite second peripheral side edge, the third flooring tray further including a third securement mechanism coupled to the bottom surface of the third flooring tray, the third securement mechanism having a portion thereof extending outwardly from the bottom surface beyond the first peripheral side edge of the third flooring tray, wherein the first flooring tray further includes a fourth securement mechanism coupled to the bottom surface of the first flooring tray, the fourth securement mechanism having a portion extending outwardly from the bottom surface beyond the second peripheral side edge, and wherein the third securement mechanism and the fourth securement mechanisms are configured to couple with one another to secure the first and third flooring trays together.

3. The flooring assembly of claim 2, further comprising:

a fourth flooring tray including a top surface and an opposite bottom surface, a header edge and an opposite footer edge, and a first peripheral side edge and an opposite second peripheral side edge, the fourth flooring tray further including a fifth securement mechanism coupled to the bottom surface of the fourth flooring tray, the fifth securement mechanism having a portion thereof extending outwardly from the bottom surface beyond the first peripheral edge of the fourth flooring tray, wherein the second flooring tray further includes a sixth securement mechanism coupled to the bottom surface of the second flooring tray, the sixth securement mechanism having a portion extending outwardly from the bottom surface beyond the second peripheral side edge, and wherein the fifth securement mechanism and the sixth securement mechanisms are configured to couple with one another to secure the second and fourth flooring trays together.

4. The flooring assembly of claim 3, wherein the fourth flooring tray further includes a seventh securement mechanism having a portion thereof extending outwardly from the bottom surface beyond the header edge, and wherein the third flooring tray further includes an eighth securement mechanism having a portion thereof extending outwardly from the bottom surface beyond the footer edge, wherein the seventh and eighth securement mechanisms are configured to couple with one another to secure the third and fourth flooring trays together.

5. The flooring assembly of claim 1, further comprising a first flooring tile coupled to the top surface of the first flooring tray, and a second flooring tile coupled to the top surface of the second flooring tray.

6. The flooring assembly of claim 1, further comprising a bracket coupled to one or both of the first and second flooring trays, the bracket configured to secure the first and second flooring trays to a support structure.

7. The flooring assembly of claim 1, wherein the third pedestal and fourth pedestal each further supports the second flooring tray along the header edge thereof.

8. The flooring assembly of claim 1, wherein the top surface of the first flooring tray and the top surface of the second flooring tray each further includes a plurality of raised protuberances extending upwardly from the respective top surface.

9. The flooring assembly of claim 8, further including a first flooring tile coupled to the top surface of the first flooring tray and a second flooring tile coupled to the top surface of the second flooring tray.

10. The flooring assembly of claim 1, wherein the top surface of each of the first flooring tray and the second flooring tray further includes a plurality of drain openings formed thereon, the drain openings extending from the top surface to the opposite bottom surface of the respective first and second flooring trays, the drain openings providing a passageway to drain water away from the first and second flooring trays.

11. The flooring assembly of claim 1, wherein the first flooring tray is supported by the first, second, third, and fourth pedestals, respectively, without a fixed attachment of the first flooring tray to any of the first, second, third, and fourth pedestals.

12. A flooring assembly comprising:

a first flooring tray including a top surface and an opposite bottom surface, a header edge and an opposite footer edge, and a first peripheral side edge and an opposite second peripheral side edge;

a first securement mechanism including a first leg portion and a first curved hook portion extending from an end of the first leg portion, wherein the first leg portion is coupled to the bottom surface of the first flooring tray, and wherein the first curved hook portion extends outwardly from the bottom surface beyond the footer edge of the first flooring tray;

a second flooring tray including a top surface and an opposite bottom surface, a header edge and an opposite footer edge, and a first peripheral side edge and an opposite second peripheral side edge; and a second securement mechanism including a second leg portion and a second curved hook portion extending from an end of the second leg portion, wherein the second leg portion is coupled to the bottom surface of the second flooring ray, and wherein the second curved hook portion extends outwardly from the bottom surface beyond the header edge of the second flooring tray, wherein the first leg segment of the first securement mechanism interlocks with the second hook portion of the second securement mechanism, and the second leg segment of the second securement mechanism interlocks with the first hook portion of the first securement mechanism to secure the first and second flooring trays together and restrain movement along a vertical axis of the first and second flooring trays.

13. The flooring assembly of claim 12, further comprising a first pedestal supporting the first flooring tray along the header edge and first peripheral side edge, a second pedestal supporting the first flooring tray along the first peripheral side edge and the footer edge, a third pedestal supporting the first flooring tray along the footer edge and the second peripheral side edge, and a fourth pedestal supporting the first flooring tray along the second peripheral side edge and the header edge.

14. The flooring assembly of claim 12, further comprising a first flooring tile coupled to the top surface of the first flooring tray, and a second flooring tile coupled to the top surface of the second flooring tray.

15. The flooring assembly of claim 12, further comprising a bracket coupled to one or both of the first and second flooring trays, the bracket configured to secure the first and second flooring trays to a support structure.

16. The flooring assembly of claim 12, wherein the top surface of each of the first flooring tray and the second flooring tray further includes a plurality of drain openings formed thereon, the drain openings extending from the top surface to the opposite bottom surface of the respective first and second flooring trays, the drain openings providing a passageway to drain water away from the first and second flooring trays.

17. A flooring assembly comprising:

a first flooring tray including a top surface and an opposite bottom surface, a header edge and an opposite footer edge, and a first peripheral side edge and an opposite second peripheral side edge;

a first securement mechanism including a first leg portion and a first curved hook portion extending from an end of the first leg portion, wherein the first leg portion is coupled to the bottom surface of the first flooring tray, and wherein the first curved hook portion extends outwardly from the bottom surface beyond the footer edge of the first flooring tray;

a second flooring tray including a top surface and an opposite bottom surface, a header edge and an opposite footer edge, and a first peripheral side edge and an opposite second peripheral side edge;

a second securement mechanism including a second leg portion and a second curved hook portion extending from an end of the second leg portion, wherein the second leg portion is coupled to the bottom surface of the second flooring tray, and wherein the second curved hook portion extends outwardly from the bottom surface beyond the header edge of the second flooring tray, wherein at least a portion of the first securement mechanism overlaps and interlocks with at least a portion of the second securement mechanism to secure the first and second flooring trays together and restrain movement along a vertical axis of the first and second flooring trays; and a bracket coupled to one or both of the first and second flooring trays, the bracket configured to secure the first and second flooring trays to a support structure.

18. The flooring assembly of claim 17, further comprising a first pedestal supporting the first flooring tray along the header edge and first peripheral side edge, a second pedestal supporting the first flooring tray along the first peripheral side edge and the footer edge, a third pedestal supporting the first flooring tray along the footer edge and the second peripheral side edge, and a fourth pedestal supporting the first flooring tray along the second peripheral side edge and the header edge.

19. The flooring assembly of claim 17, further comprising a first flooring tile coupled to the top surface of the first flooring tray, and a second flooring tile coupled to the top surface of the second flooring tray.

20. The flooring assembly of claim 17, wherein the top surface of the first flooring tray and the second flooring tray further includes a plurality of drain openings formed thereon, the drain openings extending from the top surface to the opposite bottom surface of the respective first and second flooring trays, the drain openings providing a passageway to drain water away from the first and second flooring trays.

* * * * *